United States Patent [19]

Layton

[11] Patent Number: 4,679,716

[45] Date of Patent: Jul. 14, 1987

[54] NEEDLE ORGNIZER

[76] Inventor: Marilyn Layton, 2320 SW. 46th Ter., Fort Lauderdale, Fla. 33317

[21] Appl. No.: 792,179

[22] Filed: Oct. 28, 1985

Related U.S. Application Data

[63] Continuation of Ser. No. 617,661, Jun. 4, 1984, abandoned.

[51] Int. Cl.[4] ..... A41H 31/00

[52] U.S. Cl. ..... 223/109 R; 206/338; 206/388; 223/108

[58] Field of Search ..... 223/106, 107, 108, 109 R, 223/109 A; 206/338

[56] References Cited

U.S. PATENT DOCUMENTS

| | | | |
|---|---|---|---|
| 175,680 | 4/1876 | Ellis | 223/109 R |
| 412,401 | 10/1889 | Mills | 223/109 R |
| 732,492 | 6/1903 | Alden | 223/109 R |
| 1,555,719 | 9/1925 | Scudero | 223/109 R |
| 2,067,537 | 1/1937 | Kost et al. | 223/109 R |
| 2,646,196 | 7/1953 | York | 223/106 |
| 2,703,667 | 3/1955 | DeMello | 223/107 |
| 3,084,788 | 4/1963 | Ford | 223/108 X |
| 3,949,452 | 4/1976 | Henderson | 206/338 X |
| 4,111,341 | 9/1978 | Carrozo | 223/106 |
| 4,411,363 | 10/1983 | Walker | 206/388 |

FOREIGN PATENT DOCUMENTS

| | | | |
|---|---|---|---|
| 24571 | of 1907 | United Kingdom | 223/108 |

*Primary Examiner*—Werner H. Schroeder
*Assistant Examiner*—J. L. Olds
*Attorney, Agent, or Firm*—Malin, Haley & McHale

[57] ABSTRACT

Disclosed is a needle organizer having a generally longitudinally extending pin cushion with indicia along its length. These indicia allow a user to place needles in the cushion in accordance with pre-selected criteria, such as different shades of thread attached to the needles. The organizer has a frame attached to the cushion for carrying the indicia, and, in one embodiment, provides a stand-up base for the cushion. The indicia may be in the form of a ruler, a strip on which a user can write, or a window for receiving a pre-written strip.

7 Claims, 4 Drawing Figures

NEEDLE ORGNIZER

This application is a continuation, of application Ser. No. 617,661, filed 6/4/84, now abandoned.

BACKGROUND OF THE INVENTION

Stitching often requires the use of several needles simultaneously, each needle threaded with floss or threads of different colors. While using one threaded needle, it is common to place the others in a pin cushion for handy retrieval. Unfortunately, threads often vary only slightly in color. Thus a seamstress must waste much time by visually comparing a plurality the threaded needles when it is necessary to retrieve a specific one. Any device that could reduce this waste of time and effort would be very welcome in this art.

SUMMARY OF THE INVENTION

Accordingly, it is an object of this invention to provide a needle organizer that enables one to keep visually separate a plurality of threaded needles according to the color of thread on each needle.

It is a further object of this invention to provide such an organizer by specially adapting a simple pin cushion to the task.

It is another object of this invention to provide such an organizer that is simple and rugged of construction, and inexpensive in price.

In accordance with these and other objects which shall become apparent hereinafter there is provided a needle organizer having a longitudinally extending pin cushion with indica along its length. The indica allow a user to place needles in the pin cushion in accordance with pre-selected criteria printed on the indica, for example a color code. The organizer has a frame attached to the cushion for carrying the indica, which in one embodiment is L-shaped and receives the pin cushion within the inside angle of the L. One arm of the L-shape carries the indica, the other provides a stand-up base for the needle organizer. In another embodiment, the frame is in the form of a simple longitudinally extending flat surface. The indica in either embodiment may be in the form of a longitudinally extending ruler, or a longitudinally extending strip upon which the indica are inscribed. The strip may be fixedly attached to the frame, may be integral with the frame, or the frame may carry a window into which can be inserted a strip of paper (or other suitable material) upon which the indica are inscribed.

The instant invention will be more fully understood from the following detailed description, it being understood, however, that the invention is capable of extended application, and is not confined to the precise disclosure. Changes and modifications may be made that do not affect the spirit of the invention, as expressed in the appended claims. Accordingly, the instant invention will now be described with reference to the accompanying drawings.

BRIEF DESCRIPTION OF THE DRAWINGS

Each drawing figure is a perspective view.

DETAILED DESCRIPTION OF THE PREFERRED EMBODIMENT

Figure 1:
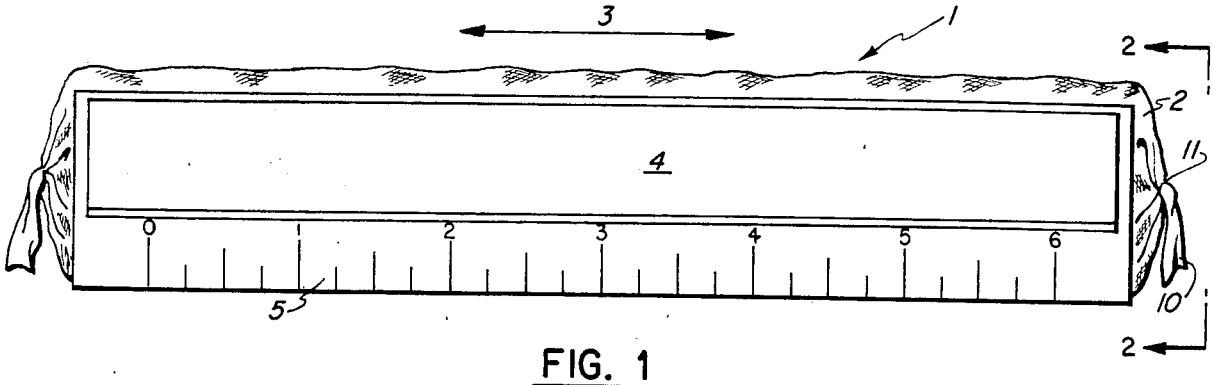
FIG. 1 shows a front view of an embodiment of the invention.
Figure 2:
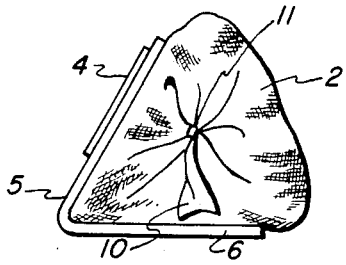
FIG. 2 is a view in the direction of lines 2—2 of FIG. 1.

With particular reference to the drawing figures, and especially FIGS. 1 and 2, there is shown a needle organizer according to the instant invention generally at 1. Organizer 1 has pin cushion 2 having a solid all antoid or cylindroid-shaped and an elongate length extending generally in longitudinal direction 3. Otherwise stated the pin cushion 2 is an elongated solid having a closed peripheral surface or closed perimetric surface similar to the shape of a sausage or hot dog. Pin cushion 2 is mounted within a frame comprising members 4, 5 and 6. This frame is generally L-shaped, with two arms (members 4 and 5 on one hand, and member 6 on the other) joined together at a central vertex. Within this vertex angle, pin cushion 2 is affixed to both arms of the frame. Portion 4 of the frame has a writing surface that is either permanently affixed to, or integral with, the frame. Portion 4 also contains permanently affixed or integral ruler portion 5. The permanent indica inscribed on ruler portion 5, and the eraseable indica that a user can write on writable portion 4, constitute the indica by which a user can delimit the portions of the longitudinal length of pin cushion 2 for receiving different categories of needles. The portions of pin cushion 2 delimited by these indica may correspond to needles having different colored threads, that is, in effect, constitute a color code. Member 6 of the frame constitutes a stand-up base for supporting organizer 1.

Figure 3:
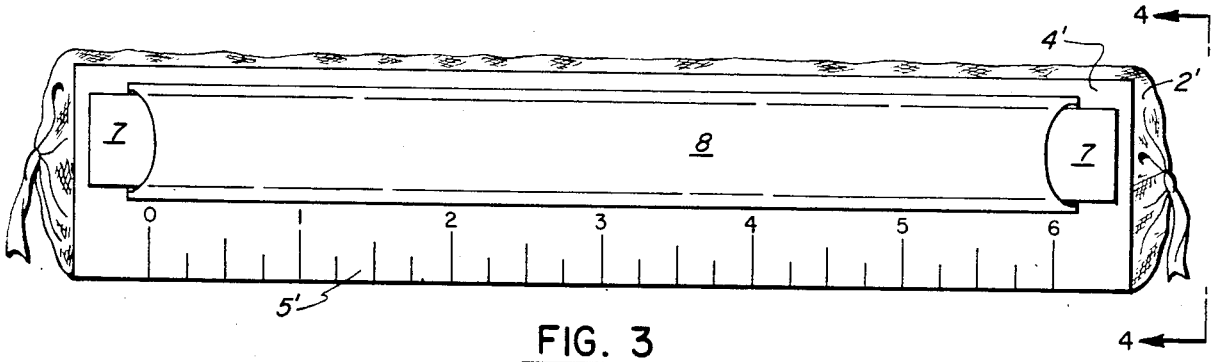
FIG. 3 is a view similar to that of FIG. 1 of an alternative embodiment of the invention.
Figure 4:
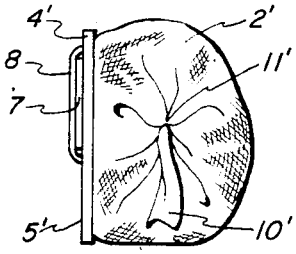
FIG. 4 is a view in the direction of lines 4—4 of FIG. 3.

With especial reference to FIGS. 3 and 4, an alternative embodiment of the invention is shown. This embodiment differs from that shown in FIGS. 1 and 2 in two major respects: First, the frame lacks any structure corresponding to base member 6 of FIG. 2. Second, instead of a writable portion 4 as shown in FIGS. 1 and 2, this embodiment contains a window 8 for receiving a strip 7 containing pre-written indica. Otherwise the two embodiments are very similar, this latter embodiment having pin cushion 2' and ruler portion 5' corresponding to members 2 and 5 of the former embodiment. Because the organizer of this embodiment rests on the pin cushion 2', rather than stand-up base 6, this embodiment is less stable than the embodiment shown in FIGS. 1 and 2, but uses less structural material to form the frame, and is hence less expensive.

Oftentimes, one does needlework in a cloth armchair, placing one's pin cushion on one armrest thereof. Thus located, a pin cushion is easily knocked off the armrest onto the floor. One way to prevent this is to provide the pin cushion with cloth arms that can be pinned to the armrest. In a preferred embodiment, pin cushion 2 can be formed of a central tube of e.g., polyester, encased by a fabric cover. The fabric cover can be cylindrical, and cushion 2 assembled by inserting the central tube within the cover and tying off the axial ends 10 of the cover by string loop 11. Any color or print fabric, cotton or blend, may be used.

Although the invention is here described by two embodiments, this division is for illustrative purposes only. In particular, one can certainly use structure from one embodiment advantageously with that of another, for example writable portion 4 of the embodiment of FIGS. 1 and 2, and window 6 with strip 7 of the embodiment of FIGS. 3 and 4, can be used interchangeably with either embodiment. More generally, the instant invention has been shown and described herein in what is considered to be the most practical and preferred embodiments. It is recognized, however, that departures may be made therefrom within the scope of the invention, and that obvious modifications may occur to a person skilled in the art. For this reason, the scope of the instant invention is to be judged solely from the appended claims.

What I claim is:

1. An organizer for selective use of a plurality of needles threaded with floss or threads of different colors comprising:

(a) frame means acutely angular in cross section and fixed in a rigid position, thereby providing an angular space, said frame means being formed by first and second planar sections, said planar sections connected together along one edge to form said acute angle, said first planar section being an organizer supporting segment which lies in a horizontal position upon a support surface, said second planar section being a means for displaying indicia, said means for displaying readily visible to a user when said organizer is placed upon a support surface;

(b) an elongate solid pin cushion of substantially uniform cross section throughout substantially its entire length, constructed of a material capable of manually receiving needles in the external surface thereof, said cushion being confined within said acutely angular frame in the rear of said organizer, said cushion being generally hidden from sight of a user behind said second planar section when said organizer is placed upon a support surface.

2. The organizer of claim 1, wherein said means for displaying comprises a window means adapted for receiving a removable strip on which is written said indica.

3. The organizer of claim 1, wherein said means for displaying comprises a strip means for carrying said indicia, said indicia being written on said strip means, said strip means disposed generally along said second planar section.

4. The organizer of claim 1, wherein said organizer further comprises a means for pinning said organizer to a surface capable of receiving said needles or the like, wherein said means for pinning comprises a plurality of lengths of fabric, each length of said plurality of lengths extending from one of a plurality of locations on said pin cushion, said plurality of lengths of fabric being adapted to be pierced by a corresponding plurality of pins, whereby to attach said organizer to said surface.

5. An organizer of claim 1 wherein said pin cushion is generally allantoid or cylindroid-shaped.

6. An organizer of claim 5 wherein said frame means includes means providing a surface capable of displaying indica corresponding to different colored threads thereby facilitating placing needles in a preselected location in the pin cushion for providing a color code.

7. An organizer of claim 1 wherein said pin cushion is bounded by a closed peripheral or perimetric surface.

* * * * *